United States Patent [19]

Calloni et al.

[11] Patent Number: 4,753,744

[45] Date of Patent: Jun. 28, 1988

[54] USE OF PERFLUOROPOLYETHERS IN MECHANICAL PUMPS

[75] Inventors: Enzo Calloni, Monza; Adriana Tasca, Milan; Luigi Stoppa, Rovigo, all of Italy

[73] Assignee: Ausimont S.p.A., Milan, Italy

[21] Appl. No.: 931,394

[22] Filed: Nov. 14, 1986

[30] Foreign Application Priority Data

Nov. 20, 1985 [IT] Italy ..... 22921 A/85

[51] Int. Cl.[4] ..... C10M 107/38

[52] U.S. Cl. ..... 252/54; 252/58

[58] Field of Search ..... 252/54

[56] References Cited

U.S. PATENT DOCUMENTS

| | | | |
|---|---|---|---|
| 3,242,218 | 3/1966 | Miller | 260/615 |
| 3,342,875 | 9/1967 | Selman et al. | 252/54 |
| 3,393,151 | 7/1968 | Dalle et al. | 252/54 |
| 3,665,041 | 5/1972 | Sianesi et al. | 252/54 |
| 3,715,378 | 2/1973 | Sianesi et al. | 260/463 |
| 3,946,083 | 3/1976 | Delaunois et al. | 252/54 |
| 3,975,448 | 8/1976 | Delaunois et al. | 252/54 |
| 4,174,461 | 11/1979 | Sianesi et al. | 252/54 |
| 4,523,039 | 6/1985 | Lagow et al. | 568/615 |
| 4,657,687 | 4/1987 | Caporiccio et al. | 252/54 |

FOREIGN PATENT DOCUMENTS

| | | |
|---|---|---|
| 0148482 | 7/1985 | European Pat. Off. . |
| 21052 A/84 | 5/1984 | Italy . |
| 22920 A/85 | 11/1985 | Italy . |
| 1104482 | 2/1968 | United Kingdom . |

*Primary Examiner*—William R. Dixon, Jr.
*Assistant Examiner*—David M. Brunsman
*Attorney, Agent, or Firm*—Stiefel, Gross & Kurland

[57] ABSTRACT

A process for the generation of vacuums $\leqq 5.10^{-4}$ torr by means of mechanical pumps, comprising using as operative fluid a perfluoropolyether having neutral end groups and containing light products, having an average molecular weight equal to or lower than 1,000, in amounts lower than or equal to 50 ppm.

3 Claims, No Drawings

USE OF PERFLUOROPOLYETHERS IN MECHANICAL PUMPS

BACKGROUND OF THE INVENTION

1. Field of the Invention

The present invention relates to the use of perfluoropolyethers in mechanical pumps for the generation of vacuums $\leqq 5\times10^{-4}$ torr.

2. The Prior Art

The use of perfluoropolyethers in the vacuum pumps is well known, due to the high stability of these compounds which permits their viscosity variation to be sufficiently low during the operation of the pumps.

The perfluoropolyethers are the best fluid to be used in said vacuum apparatuses as compared with the conventional fluids, such as mineral and silicone oils, since the latter tend to decompose owing to both the heat generated by friction forces during the pump run, and to the chemical action of the substances entering the pump during its run. However, also the perfluoropolyethers utilized at present in the vacuum technique do not enable to reach high vacuums, i.e. lower than or equal to $5\times10^{-4}$ torr.

The vacuum usually obtained with said perfluoropolyethers is of the order of $10^{-3}$ torr.

The mechanical pumps are generally used in the field of microelectronics, in particular in that of semiconductors.

In these fields, the composition of the residual atmosphere in the vacuum chamber where the semiconductor processing takes place is critical.

It has been observed that the perfluoropolyethers utilized at present do not permit to obtain residual atmospheres with a sufficiently low pollution degree, as is required for the electronics processing. For this reason, the residual impurities cause a considerable reduction of the number of utilizable semiconductor pieces.

THE PRESENT INVENTION

By consequence, there is the requirement of an operative fluid for mechanical pumps for reaching vacuums $\leqq 10^{-4}$ torr, so as to obtain residual atmospheres having a very low impurities content.

It has surprisingly been found that the abovesaid requirements are met by using as operative fluid for mechanical pumps a perfluoropolyether containing perfluoropolyethers having an average molecular weight lower than 1,000, in amounts not exceeding 50 ppm, preferably not exceeding 30 ppm.

Any perfluoropolyether with neutral end groups is utilizable for the present invention.

For example Fomblin® by Montedison and Krytox® by DuPont may be cited.

Said perfluoropolyethers are described in patents GB No. 1,104,482, U.S. Pat. No. 3,665,041, U.S. Pat. No. 3,715,378, U.S. Pat. No. 3,242,218.

Further perfluoropolyethers are described in European patent application No. 148,482 in the name of Daikin. One may also use the perfluoropolyethers described in U.S. Pat. No. 4,523,039.

One may also use difunctional perfluoropolyethers produced by Daikin or Krytox, in which end groups COF have been neutralized by means of known techniques. As regards this, the products described in European patent application Nos. 148,482 and 151,877 may be cited.

Furthermore, one may also use functional perfluoropolyethers prepared from neutral perfluoropolyethers according to Italian patent application No. 22920 A/85 in the name of the Applicant.

The perfluoropolyethers (PFPE) utilizable according to the present invention are prepared from the raw products described hereinbefore by fractionated distillation to reduce the content of the perfluoropolyethers having an average molecular weight $\leqq 1{,}000$ to the values specified above.

The viscosity of the PFPE generally range from 40 to 350 cSt as a function of the type of pump designed for the specific applications. Generally, perfluoropolyethers having a viscosity within a narrow range are preferred.

For example, if the oil utilized for a certain processing must have a viscosity of 270 cSt, the viscosity variation is preferably between more or less 20 cSt.

The perfluoropolyethers useful for the present invention can be also obtained by scission, by means of substances such as $AlF_3$, of high-viscosity perfluoropolyethers and by subsequent distillation in order to obtain the viscosity values in the above-said ranges. This method is described for example in Italian patent applicaton No. 21052 A/84 in the name of the Applicant.

Other utilizable catalysts for the said scission are the oxyfluorides and the fluorides of the transition metals, in particular of Ti, Co, Ni; or the oxides, preferably of Ti, Al.

Said catalysts are described in the cited patent application and in other later applications in the name of the Applicant.

A further advantage deriving from the use of the PFPE of the present invention consists in that the oil consumption during the run of the pump is minimum.

In fact, even after long running periods of the pump, nearly no oil consumption occurs, as described in Example 1.

This is a remarkable advantage since these types of oils are very expensive.

Mechanical pumps of any type can be utilized to generate the vacuums described in the invention. Mechanical blade pumps are particularly suitable.

The following examples are illustrative and not limitative of the invention.

EXAMPLE 1

Into two identical pumping systems, each consisting of a mechanical pump 2063 CP manufactured by Cit Alcatel, equipped with a filter D and a 500 $m^3/h$ Roots Blowers pump, there were charged 40 kg of Fomblin 27 HP into the first system and an equal amount of Fomblin® Y L-VAC 25/6 into the second system.

After a three-month run under identical conditions, during 24 hours/day, the amount of oil necessary to make up for the losses due to the pump run was 1 kg/week in the system charged with L-VAC 25/6.

On the contrary, in the system charged with Fomblin 27 HP there was no need to fill up oil after the same run conditions, whereby a 25% saving on the oil consumption was attained.

EXAMPLE 2

Fomblin® HP are utilized chiefly as fluids for vacuum pumps in the microelectronics field, where the composition of the residual atmosphere in the reaction chamber is of great importance.

The vacuum pump described in Example 1 was used.

By means of the neutronic activation technique it is possible to determine the amounts of polluting substances directly on the surface of the substrates placed in the vacuum chambers.

In Table 1 are compared the results of the analyses carried out by the abovesaid technique on substrates placed in two vacuum chambers, in the first of which the vacuum was generated by a pumping system charged with Fomblin® 27 HP, while in the second chamber the vacuum was generated by another system charged with Fomblin® Y L-VAC 25/6.

TABLE 1

| | 27 HP | 25/6 |
|---|---|---|
| Na | 20 ppb | 160 ppb |
| K | 50 ppb | 1000 ppb |
| Cl | 1500 ppb | 3700 ppb |
| Li | 0 | very high |

It is evident that the amounts of the elements considered as the most dangerous—since they remarkably lower the yields of utilizable products (semiconductors)—which are Na, K and Li, are by far lower in oil 27 HP as compared with oil 25/6.

The vacuum generated by the pump which utilized Fomblin® 27 HP was $2\times10^{-4}$ torr, while the vacuum obtained with Fomblin® L-VAC 25/6 was $6\times10^{-3}$ torr.

The amount of perfluoropolyethers having an average molecular weight $\leqq$1,000 was 15–20 ppm in Fomblin® 27 HP and 90 ppm in Fomblin® L-VAC.

The viscosity of Fomblin® 27 HP was of 270 cSt±20 cSt as the viscosity of Fomblin® L-VAC.

The same example was repeated with Fomblin 15 HP (viscosity=150 cSt±20 cSt) and the vacuums obtained were $3\times10^{-4}$ torr, the fraction of light perfluoropolyethers (M.W. lower than 1,000) being 20 ppm.

The amount of impurities (see Table 1) was of the same order of magnitude as for Fomblin® 27 HP.

What is claimed is:

1. A process for generating a vacuum not in excess of about $5\times10^{-4}$ torr by operating a mechanical pump containing a fluid which comprises a perfluoropolyether having neutral end groups, the amount of said perfluoropolyether having a molecular weight not in excess of 1,000 being not greater than 50 ppm.

2. The process of claim 1, wherein the content of perfluoropolyethers having an average molecular weight $\leqq$1,000 is $\leqq$30 ppm.

3. The process of claim 1, wherein the perfluoropolyether viscosity is from 40 to 350 cSt.

* * * * *